US005267930A

United States Patent [19]

Henes

[11] Patent Number: 5,267,930

[45] Date of Patent: Dec. 7, 1993

[54] EXERCISE MACHINE EMPLOYING IMPROVED LEG AND FOOT EXERCISING FIXTURE

[76] Inventor: Richard W. Henes, 5816 E. Mockingbird La., Paradise Valley, Ariz. 85253

[21] Appl. No.: 1,563

[22] Filed: Jan. 6, 1993

[51] Int. Cl.[5] ..... A63B 21/00

[52] U.S. Cl. ..... 482/139; 482/102; 482/133

[58] Field of Search ..... 482/97-104, 482/125, 133-139

[56] References Cited

U.S. PATENT DOCUMENTS

| | | | |
|---|---|---|---|
| 1,980,861 | 11/1934 | Hunter | 482/125 |
| 3,640,527 | 2/1972 | Proctor . | |
| 3,708,166 | 1/1973 | Annas . | |
| 3,912,261 | 10/1975 | Lambert, Sr. . | |
| 4,149,713 | 4/1979 | McLeod . | |
| 4,296,924 | 10/1981 | Anzaldua et al. . | |
| 4,349,194 | 9/1982 | Lambert, Jr. et al. . | |
| 4,482,152 | 11/1984 | Wolff . | |
| 4,505,475 | 3/1985 | Olschansky et al. . | |
| 4,541,628 | 9/1985 | Parviainen . | |
| 4,603,855 | 8/1986 | Sebelle . | |
| 4,635,933 | 1/1987 | Schnell . | |
| 4,684,122 | 8/1987 | Desmond et al. | 482/139 X |
| 4,721,303 | 1/1988 | Fitzpatrick . | |
| 4,756,527 | 7/1988 | Ledbetter | 482/139 |
| 4,757,992 | 7/1988 | Heitsch et al. . | |
| 4,768,783 | 9/1988 | Engalitcheff, Jr. | 482/139 |
| 4,807,873 | 2/1989 | Naquin | 482/139 X |
| 4,809,972 | 3/1989 | Rasmussen et al. . | |
| 4,826,157 | 5/1989 | Fitzpatrick . | |
| 4,844,456 | 7/1989 | Habing et al. . | |
| 4,900,018 | 2/1990 | Ish, III et al. . | |
| 4,949,957 | 8/1990 | Cucchiara | 482/102 X |
| 4,953,855 | 9/1990 | Shields . | |
| 4,974,837 | 12/1990 | Someya et al. . | |

*Primary Examiner*—Robert Bahr

*Attorney, Agent, or Firm*—Warren F. B. Lindsley

[57] ABSTRACT

This invention is directed to an exercising apparatus on which multiple exercising routines may be performed from a single station area operating in opposition to a single set of weights and wherein the cable systems are operably independent from each other. A single leg extension fixture is disclosed which provides leg and foot extension exercises together with foot curl, leg and leg curl exercises.

14 Claims, 3 Drawing Sheets

EXERCISE MACHINE EMPLOYING IMPROVED LEG AND FOOT EXERCISING FIXTURE

BACKGROUND OF THE INVENTION

This invention relates to exercise machines of the type having multiple exercise units which operate in opposition to a single source of reactance to movement such as a stack of free weights or a weight simulator. More particularly, the machine is adapted for use in the home or gym where space is at a premium and multiple exercise functions can be perfectly performed from a single station area at one side of the machine.

Exercise of the human body is accomplished against reactance to movement imposed on ropes or cables utilizing the force of gravity, spring pressure, an air cylinder, a rubber band, electro magnetism, dynamic friction, or the like, which ropes or cables issue from the apparatus at various heights depending on the nature of the specific exercise and the build of the person using the apparatus.

The present invention provides a simplified arrangement in which multiple exercise units are continuously connected to a source of reactance to movement such as a single weight set by a pulley and cable system employing a low level pulley exercise fixture which provides superior exercises with reduced structure.

DESCRIPTION OF THE PRIOR ART

Various types of exercising equipment departing from the form of the conventional weight lifting sets are described in the prior art.

The following patents appear to be of general interest but are not believed to anticipate the claimed invention.

| | |
|---|---|
| 4,953,855 | 4,349,194 |
| 4,505,475 | 4,482,152 |
| 4,844,456 | 3,708,166 |
| 4,809,972 | 4,826,157 |
| 4,900,018 | 4,635,933 |
| 4,541,628 | 3,640,527 |
| 3,912,261 | 4,149,713 |
| 4,603.855 | 4,296,924 |
| 4,757,992 | 4,974,837 |

U.S. Pat. No. 4,953,855 discloses a split phase cam-controlled weight lifting exercise machine employing two independent selectable weight stacks connected by cable and pulley assemblies.

U.S. Pat. No. 4,505,475 discloses an exercise system providing reversible displacement of at least one weight element.

U.S. Pat. Nos. 4,844,456; 4,809,972 and 4,900,018 disclose multi station areas.

U.S. Pat. No. 4,541,628 discloses a means of connecting the forces of an athlete's body over an eccentric rotatable element.

U.S. Pat. No. 3,912,261 discloses a cable system which extends from eccentric pulleys rotated by the exercise action of the user to an adjustable weight unit. The eccentric pulley varies the weight load during each exercise cycle to provide uniform exercise for the muscles.

U.S. Pat. No. 4,603,855 discloses an exercise apparatus having cables pullable against varying resistance along one or more horizontal arms adjustable as to height, length and as to the angle of the arms to each other and to the frame of the apparatus.

U.S. Pat. Nos. 4,757,992; 4,349,194; 4,482,152; 3,708,166 and 4,826,157 disclose a single seat exercise apparatus for providing various exercises.

U.S. Pat. No. 4,974,837 discloses an exercise apparatus employing a shock damper that damps shock and vibrations generated by the impact of lifted weight blocks.

U.S. Pat. No. 4,296,924 discloses a rectangular frame wherein the exerciser remains in an upright position while exercising.

U.S. Pat. No. 4,635,933 discloses an exercising device employing a transmission having selected transmission ratios to which an arm of the exercising device is attached.

U.S. Pat. No. 3,640,527 discloses an exercising machine wherein the machine employs a padded table upon which the person using the exercise machine may lie in a faceup position.

U.S. Pat. No. 4,149,713 discloses a weight lifting device for the lower extremities employing a table having a horizontally translatable chair mounted thereon.

None of the patents disclose the claimed leg extension exercising fixture which provides, inter alia, 1. Leg extension exercises;
2. Foot extension (calf raise) exercises;
3. Foot curl exercises;
4. Leg lift exercises;
5. Leg curl exercises; and
6. Leg press exercise.

SUMMARY OF THE INVENTION

In accordance with the invention claimed, a new and improved exercising device is disclosed which materially reduces the structure necessary for performing various leg and foot exercises and increases the effectiveness of the exercises.

It is, therefore, one object of this invention to provide a new and improved leg and foot exercising fixture for an exercising machine utilizing the exerciser's skeletal joints as pivot points.

Another object of this invention is to provide an improved leg extension fixture for exercising apparatus that aids in practicing all the conventional leg and foot exercises at a single station.

A further object of this invention is to provide an improved leg extension fixture for an exercising machine that exercises various leg, foot and stomach muscles with a minimum amount of equipment and no mechanical pivot joints. The machine follows natural skeletal joints of exerciser.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
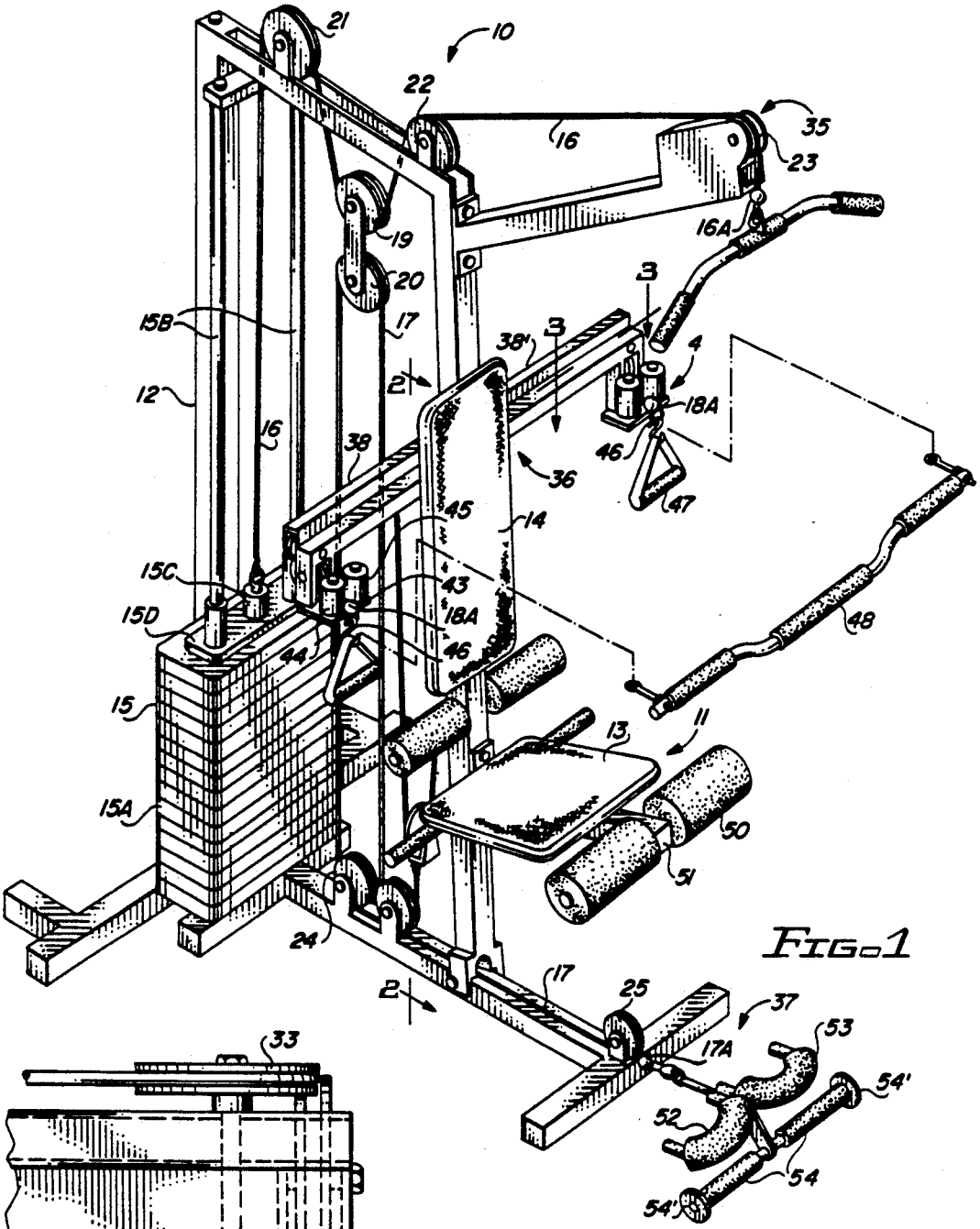
FIG. 1 is a perspective view of an exercising device embodying the invention.
Figure 3:
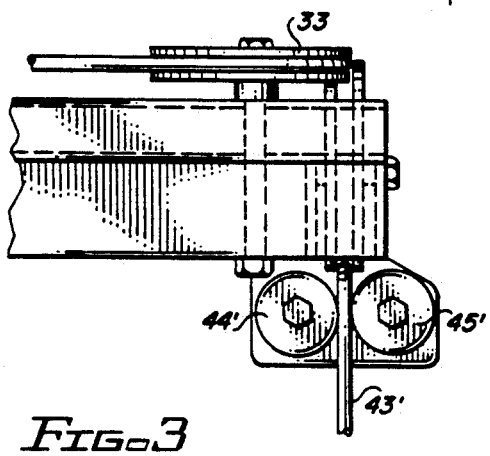
FIG. 3 is a cross sectional view of FIG. 1 taken along the line 3—3.
Figure 2:
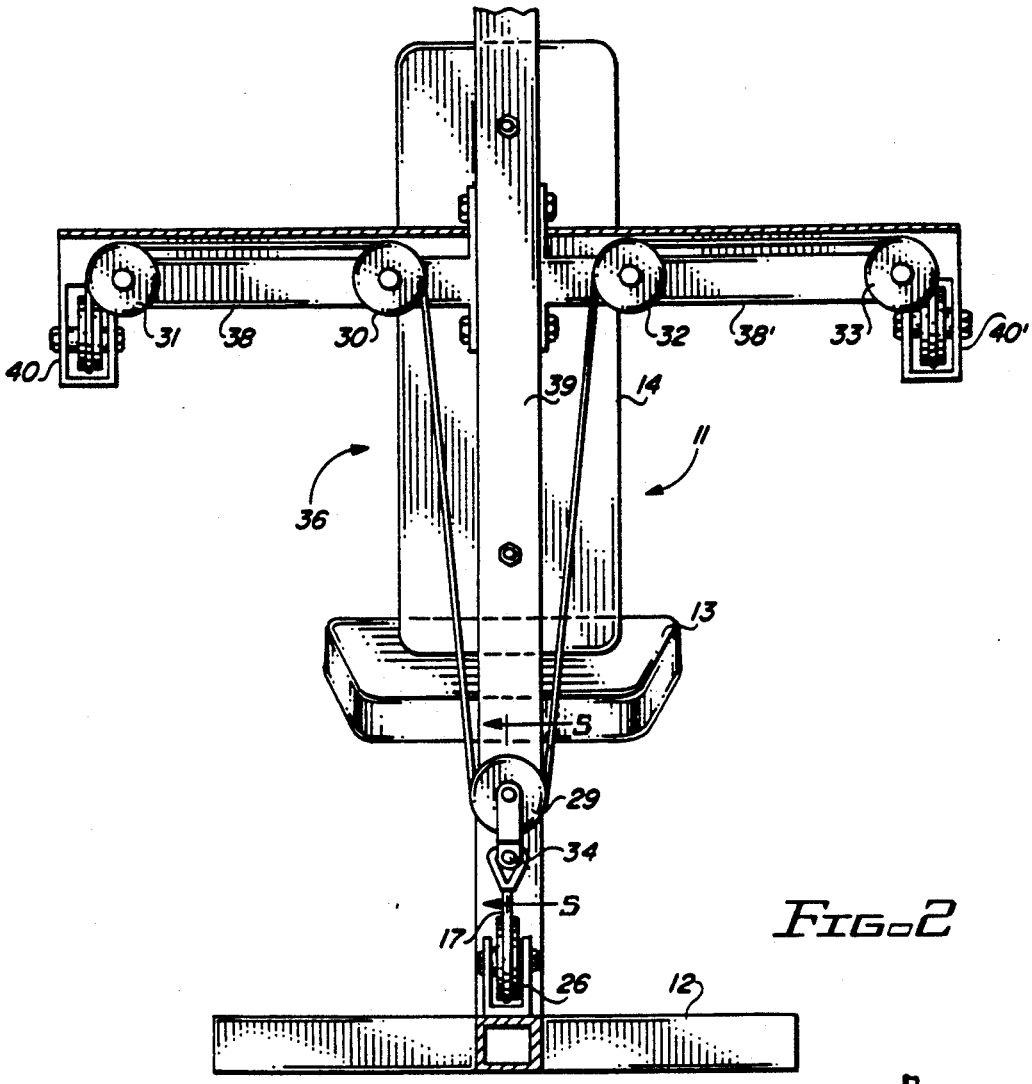
FIG. 2 is a cross sectional view of FIG. 1 taken along the line 2—2.

Referring more particularly to the drawings by characters of reference, FIGS. 1–2 disclose an exercising device 10 embodying the invention and comprising an exercising station 11 mounted at one side of frame 12. The station comprises a seat 13 and back rest 14 from which a user may operatively lift weights of a restraining means such as weight stack unit 15 resting on the base of frame 12. At this one station various exercising routines may be undertaken such as, for example, high pull, shoulder press, butterfly, abdominal crunch, leg curl and extension and low pull activities.

The weight stack unit 15 is of standard construction comprising a stack of rectangular weights 15A which are slide mounted on a pair of vertical guide rods 15B with each weight having a central horizontal hole registering with a respective hole in a central. pick-up rod 15C. This pick-up rod depends from a head plate 15D which is also slide mounted on rods 15B and has a lift cable 16 secured thereto. The amount of weight to be lifted is selected by engaging a lock pin (not shown) through the appropriate one of the weights 15A into the pickup rod 15C. Thus, when the cable 16 is adequately tensioned, the selected number of weights in the stack is lifted.

Figure 5:
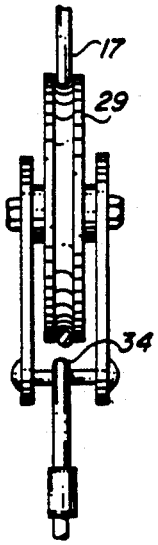
FIG. 5 is a cross sectional view of FIG. 2 taken along the line 6—6.

As shown in FIGS. 1 and 6A–6C, cable 16 functions in conjunction with cables 17 and 18 by way of floating pulley set 19–20, the two pulleys in the set being coupled together. Cable 16 is guided by three guide pulleys 21, 22 and 23. Cable 17 is guided by four guide pulleys 24, 25 and 26 and passes beneath the floating pulley 19. Cable 17 passes over the floating pulley 20 and is guided by guide pulleys 24–26. Cable 18 passes over the floating pulley 29 and is guided by guide pulleys 30, 31. 32 and 33 as shown in FIG. 2. Floating pulley 29, as shown in FIG. 5 is connected at point 34 to one end of cable 17.

The high pull unit 35 is connected to one end of cable 16, the mid-level unit 36 is connected at the center of cable 18 to one end of cable 17, the leg curl extension unit 37 is connected to the other end of cable 17. The cables 16, 17 and 18 all have ball or cylinder like stop fittings 16A, 17A and 18A, respectively at their free ends to restrict retraction of the cables.

With the described pulley and cable arrangement it can be seen that the tension in the three cables 16, 17 and 18 is equal whenever one of them is tensioned by operation of an exercise unit. The tension in each half of cable 18 is one half the tension in cables 16 and 17.

Adjacent the mid-level unit 36 and about shoulder height of a user seated on seat 13 with his or her back resting on back rest 14 is provided a pair of axially aligned cross bars 38, 38′ which extend laterally of and are attached to upright member 39 of frame 12. To each free end of cross bars 38, 38′ is pivotally mounted right angle frame members 40, 40′.

Figure 4:
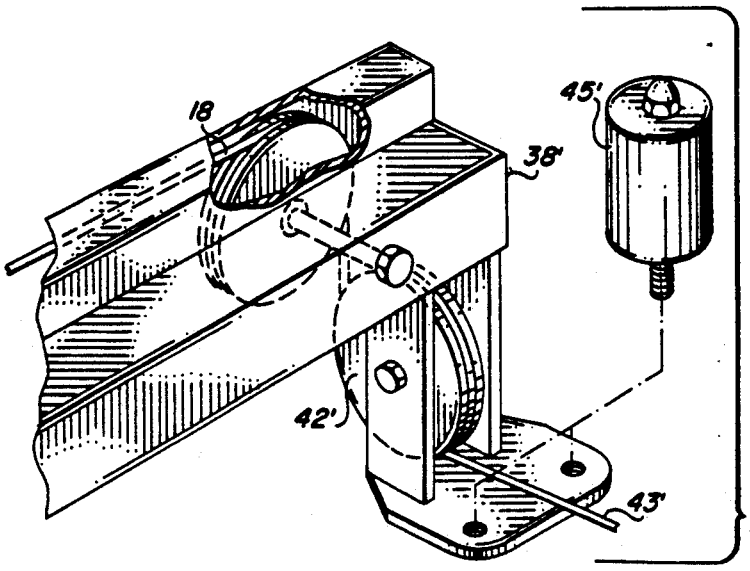
FIG. 4 is an enlargement partially of the circled area 4 of FIG. 1.

At the ends of each of cross bar 38, 38′ are mounted cable transfer pulleys 42, 42′ as shown in FIG. 4, which transfer the direction of movement of ends 43, 43′ of cable 18 laterally of arms 38, 38′ through a pair of rollers 44, 45 and 44′, 45′ to stops or ball cylinders 18A. Extending from each of stops 18A is a hook 46 for attachment to hand grips 47 or press bar 48 as illustrated in FIG. 1.

An exerciser, utilizing a single hand grip 47 attached to the hook at the end of cable 16 at the high pulley unit 35 may perform vertical butterfly sweeps, horizontal triceps presses, down slant triceps presses and variations thereof by moving the grip out forwardly of the machine in the plane of the high pulley unit 35. These exercises are performed with one arm at a time while standing.

An exerciser, utilizing a single elongated lat bar connected at its mid point to the hook at the end of cable 16 at the high pulley unit 35 location, may perform front lat pull downs, military pull downs, chinning pull downs, stomach crunches and triceps presses. These exercises are performed with both hands gripping the lat bar simultaneously. The exerciser may perform the exercises either standing, kneeling or seated while facing either toward or away from the machine frame 12.

When an exerciser seated on seat 13, facing forward, desires to perform mid-level pulley exercises, he or she may attach press bar 48 to hooks 46 so that press bar 48 rests against his or her chest. Press bar 48 is then pushed forward horizontally, in a downward slanting direction or in an upwardly slanting direction, or upward vertically, to accomplish shoulder press exercises. Also, in this position, an exerciser may bend forward with press bar 48 against the chest to perform stomach crunch exercises. Using press bar 48, the exerciser may also stand or sit facing back rest 14, and then pull press bar 48 toward himself or herself at varying angles to accomplish row exercises.

An exerciser seated on seat 13, facing forward, may also perform mid-level pulley exercises by attaching hand grips 47 to hooks 46 and then arcuately swinging both hand grips 47 simultaneously forward in sweeping horizontal, down slanting, up slanting or vertical arcs to perform pectoral fly exercises. By swinging the right hand grip 47 singly with the left hand and the left hand grip 47 singly with the right hand, an exerciser can perform a reverse variation of the customary pectoral fly exercise. These exercises all utilize continuously varying compound angle travel of cable 18 over pulleys 42, 42′ and rollers 44, 44′ and 45, 45′, which travel is made possible by the pulley/roller combination shown in FIGS. 4 and 5.

An exerciser may stand on the floor or sit on seat 13 facing back rest 14, gripping one hand grip 47 in each hand, and perform double biceps curls by drawing the hand grips 47 horizontally toward his or her body. Variations of this exercise are possible by drawing the hand grips 47 in down slant or up slant directions toward the body.

In all of the mid-level pulley exercises, the movement of the press bar 48, grips 47 tensions cable 18 and pulls it over the outer surfaces of rollers 44, 44′ and 45, 45′ in opposition to the selected number of weights in the weight stack 15. The ends of cable 18 are free to move up and down longitudinally along the outer surfaces of rollers 44, 44′ and 45, 45′ as exercises are performed.

It should be noted that seat 13 may be used by the exerciser for the mid-level pulley exercises, the high pulley exercises and the low pulley exercises without the movable components of any unit being in the way of the exerciser when not in use.

The seat assembly at station 11 and the leg curl extension unit or fixture 37 are used to perform the leg extension and leg curl exercises with the base of frame 12 supporting pulleys 24 and 25.

To perform the leg extension exercises in the manner claimed, the user sits on seat 13 with his or her knees extending over padded supports 50. The legs then may be free to swing forward away from the end of the support arm 51. The insteps of the exerciser's ankles are then hooked into bows 52, 53 of fixture 37 while the exerciser is seated on the exercise machine seat 13 and is facing forward. The exerciser's knees are both at right angles and hanging freely toward the floor. The bottoms of the exerciser's feet (and/or toes) are above wheel mounted extension bar 54 so that the feet are covered, top and bottom, with the fixture structure. Extension bar 54 with wheels 54' one mounted at each end is mounted through arm 55 to a rigid assembly of bows 52 and 53. Bows 52 and 53 comprise arcuate rods 56, 57 each at least partially covered with a resilient covering 58. The exerciser, when he (or she) extends and straightens the legs, pulls cable 17 forward swinging around his (or her) own actual skeletal knee joint and lifts the weight stack, thus putting stress on the leg extender muscles. This is the leg extension exercise and is repeated several times at each session.

With the fixture connected in the same manner as above, and with the exerciser's feet in the same position with respect to the fixture, the exerciser has a second option of doing foot extension exercises. With the legs held in the fixed right angle position, the exerciser bends only his or her feet in a downward direction around his (or her) ankle joint. The forward portions of the bottoms of the feet (and toes) push against the extension bar 54. This tilts the leg extension fixture 37 and lifts the weight stack. The weight stack is raised a shorter distance than is the case in the leg extension exercise because the feet are shorter than the leg, but the stack is nevertheless raised. This maneuver exercises the muscles which control foot extension, much like standing calf raise exercises.

With the fixture connected in the same manner as above, but with the exerciser's feet in a slightly altered position, with the toes below the extension bar 54, and with the foot insteps hooked into the fixture, the exerciser curls the feet upward around his (or her) ankle joint while maintaining the legs in a fixed right angle position. This tilts the leg extension fixture and lifts the weight stack. In this exercise the weight stack is raised only a short distance, but effectively exercises the foot curl muscles.

In a further exercise, the exerciser leaves the machine seat and sits on the floor in front of the machine, facing the machine. The leg extension fixture 37 is left connected to the machine in the same manner as in the foregoing exercises. The exerciser hooks the feet into the fixture with the foot insteps in the respective fixture bows and the arches of the feet above the wheel mounted extension bar segments. Each foot is essentially between one bow and the opposing extension bar segment. The exerciser, while optionally leaning back on his or her hands, with arms held straight, pulls the legs toward the body sliding the heels along the floor. In doing this, the exerciser accomplishes "leg lift" type exercises which work the stomach muscles. Each time the legs move toward the body, the weight stack is lifted.

In a still further exercise, the exerciser turns over onto the stomach with the feet close to the machine and the head outboard, looking forward and away from the machine. The leg extension fixture is rotated 180 degrees on its axis common with the longitudinal axis of the basebar of the machine so that the bows are in a common plane (essentially on the floor) below the extension bar. The exerciser, while lying on the stomach, hooks the back of the heels (against the Achilles tendon) onto the right and left segments of the extension bar 54 and the foot insteps into the respective bows of the leg extension fixture 37 while the legs are in an essentially extended position. The exerciser then bends the knees raising the feet upward until the legs form essentially right angles at the knees. This bending motion raises the weight stack significantly, exercising the leg curling muscles. This exercise can also be done with the leg extension fixture in its normal position (rotated 180 degrees), but with some greater difficulty. The exerciser's knee joints comprise the pivot points.

Figure 6A:
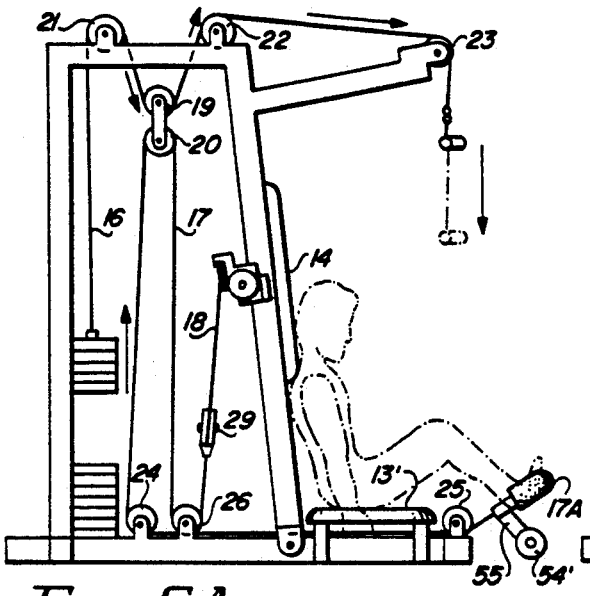
FIGS. 6A–6C illustrate various exercises that can be implemented with the exercising device shown.
Figure 6C:
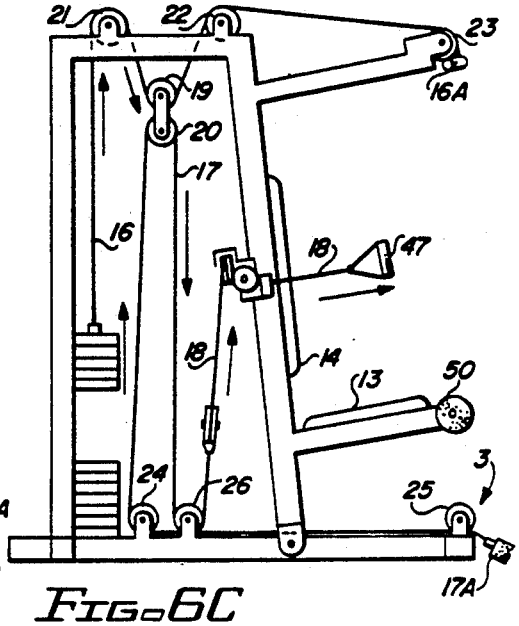
Figure 6B:
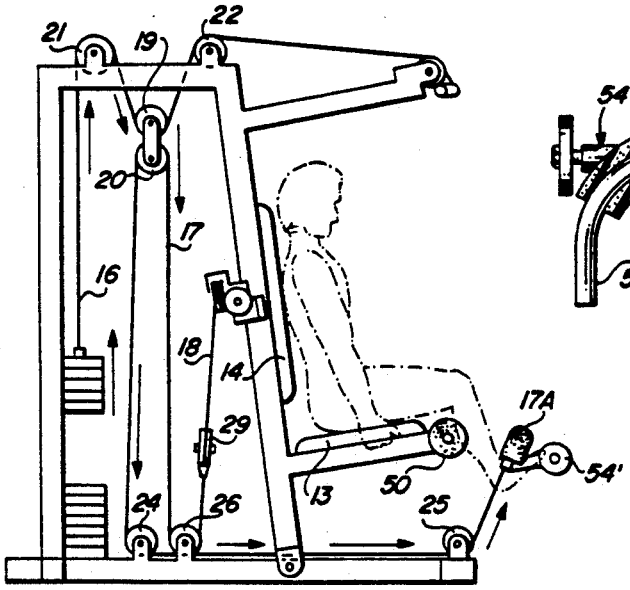
Figure 7:
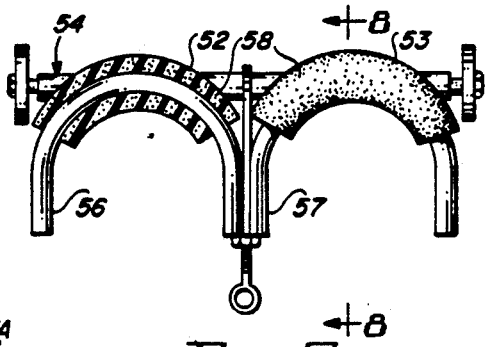
FIG. 7 is an enlarged view partially in section showing the foot and leg extension fixture shown in FIG. 1.
Figure 8:
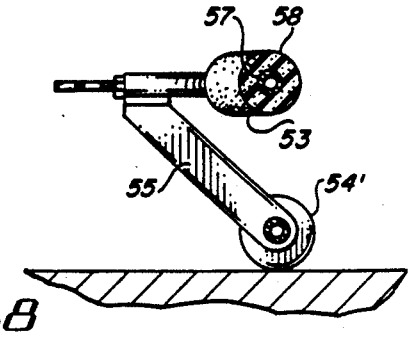
FIG. 8 is a cross sectional view of FIG. 7 taken along the line 7—7.

Another leg press exercise may be performed with the leg extension fixture as illustrated in FIG. 6A. In this instance, seat 13 is removed from upright member 39 and a stool 13' is placed at its base. The exerciser sits on stool 13' facing away from member 39 with the soles of his or her feet on top of bows 52 and 53, as shown. The, by extending the legs and then retracting them, the weights of the exercising machine may be raised and lowered in a leg press exercise.

The foregoing six exercises extend the usefulness of the leg extension fixture and really eliminate the need for extra machine structure to permit exercise of the various leg and stomach muscles. Extra structure is no longer essential for leg and foot extension, foot curl, leg lift, leg curl and leg press exercises. The exerciser's joints provide the anatomically correct pivot points.

As described herein the invention claimed is directed to a single stage of performance for a number of exercises which employ unrestricted high level pulley exercises, unrestricted mid-level (seated or standing) exercises and unrestricted low level pulley exercises.

The mid-level pulleys, one to the left and one to the right of the user, at approximately shoulder height, and slightly to the rear of the user when seated, makes it possible to perform a number of exercises at a single station.

Conventional multiple function exercise machines normally provide a high pulley station, a low pulley station and two separate mid-level work stations. The invention claimed herein provides all of these functions at one station thereby dramatically reducing space requirements of the new exercise machine, greatly reducing the material mass and costs of the new exercise machine and greatly increasing the machine's versatility.

For example, at the single station of the exercise machine disclosed, the high level pulley exercises such as front lateral pulldowns; rear lateral pulldowns; chinning pulldowns; triceps pressdowns; triceps extensions; rear triceps extensions; abdominal crunches; vertical butterfly sweeps; and variations thereof may be performed.

At the single station mid-level exercises such as pectoral flies; pectoral sweeps; high, mid-level and low bench presses; incline presses; shoulder presses; full vertical presses; military presses; horizontal and inclined standing rows; single and double biceps curls;

triceps extensions and variations thereof may be performed.

At the low-level position of the cable arrangement exercises such as leg extensions; leg curls; foot extension; foot curls; low and upright rows; bicep curls; bent knee sit ups; inside, outside and rear leg raises; sitting leg lifts; side lateral arm raises; tricep kick backs, leg press and all variations thereof may be performed.

All of this is accomplished by a single station exercise machine employing a single source of reactance to movement such as a set of weights, and a plurality of unrestricted cable arrangements with a mid-level pulley system. Each cable operates in a generally vertical plane with the second and third cable arrangements operating in vertical planes extending laterally of each other.

It should be noted that an omnidirectional exercising movement of the fixture by the feet of an exerciser is translated into movement of the source of reactance without the need for intervening mechanical pivot joints which may or may not coincide with the corresponding skeletal joints of the exerciser.

An effective exercise machine is thus provided in accordance with the stated objects of the invention and although but one embodiment of the invention has been illustrated and described, it will be apparent to those skilled in the art that various changes and modifications may be made therein without departing from the spirit of the invention or from the scope of the appended claims.

What is claimed is:

1. An exercise apparatus comprising:
a rigid frame,
a source of reactance to movement mounted on said frame,
a single exercise station for performing a plurality of exercising procedures therefrom,
said single exercise station comprising a seat for performing leg extension exercise procedures therefrom,
at least two exercise units operable from said station,
a cable and pulley system connected to each of said exercise units when the exercise units are in use,
said cable and pulley system comprising a plurality of separate cables and associated pulleys,
the first of said cables being connected to said source of reactance to movement at one end thereof and at the other end to a first exercise unit mounted on said frame,
two floating pulleys coupled together,
said first cable passing over one of said floating pulleys,
a second cable passing over the other of said floating pulleys with the first end of said second cable being connected to said leg extension station at the base of said frame,
said leg extension station comprising a fixture employing a pair of bows one for fitting around at least a part of a different one of the ankles of a user and an extension bar mounted juxtapositioned to and extending outwardly and away from said bows for engagement by the feet of a user,
whereby when the exerciser's ankles are hooked into said bows when seated on said seat facing outwardly of said apparatus with the bottom of the feet of the user on the top of said extension bar the user may actuate said reactance upon extension of the legs of the user.

2. The exercise apparatus set forth in claim 1 in further combination with:
a pair of wheels mounted one at each end of said extension bar for rolling over the apparatus horizontal supporting surface.

3. The exercise apparatus set forth in claim 1 wherein:
said source of reactance to movement comprises a movable weight mounted on said frame for displacement vertically thereof.

4. The exercise apparatus set forth in claim 1 wherein:
each of said bows comprises an arcuate configuration formed of a rigid material.

5. The exercise apparatus set forth in claim 1 wherein:
each arcuate configuration is provided with a resilient cover extending along at least a part of its length.

6. The exercise apparatus set forth in claim 1 wherein:
said extension bar is connected to said bows.

7. The exercise apparatus set forth in claim 1 wherein:
said bows are rigidly attached to each other in a planar arrangement.

8. An exercise apparatus comprising:
a rigid frame,
a source of reactance to movement mounted on said frame,
an exercise station comprising a seat for performing leg extension exercise procedures therefrom,
a cable and pulley system connected to said exercise station and said source of reactance when the exercise apparatus is in use,
a leg extension fixture connected to said cable and pulley system comprising a pair of bows one for fitting around at least a part of a different one of the ankles of a user and an extension bar mounted juxtapositioned to and extending outwardly and away from said bows for engagement by the feet of a user,
whereby an omnidirectional exercising movement of the fixture by the feet of an exerciser is translated into movement of said source of reactance without the need for intervening mechanical pivot joints which may or may not coincide with the corresponding skeletal joints of the exerciser.

9. The exercise apparatus set forth in claim 8 in further combination with:
a pair of wheels one journalled on each end of said extension bar for rolling across the apparatus supporting surface.

10. The exercise apparatus set forth in claim 8 wherein:
each of said bows comprises an arcuate configuration formed of a rigid material.

11. The exercise apparatus set forth in claim 8 wherein:
each arcuate configuration is provided with a resilient cover extending along at least a part of its length.

12. The exercise apparatus set forth in claim 8 wherein:
said extension bar is connected to said bows.

13. The exercise apparatus set forth in claim 8 wherein:
said bows are rigidly attached to each other in a planar arrangement.

14. An exercise apparatus comprising:
a rigid frame,
a source of reactance to movement mounted on said frame, an exercise station for performing a plurality of exercising procedures therefrom, said exercise station comprising a seat for the user in performing leg extension exercise procedures therefrom, a cable and pulley system continuously connected to said exercise station when the apparatus is in use, said cable and pulley station being connected to said source of reactance to movement at one end thereof and at the other end to said exercise station, said exercise station comprising a fixture employing a pair of bows one for fitting around at least a part of a different one of the ankles of a user and an extension bar mounted juxtapositioned to and extending outwardly and away from said bows for engagement by the feet of a user, whereby when the exerciser's ankles are hooked into said bows when seated on said seat facing outwardly of said apparatus with the bottom of the feet of the user on the top of said extension bar the user may actuate said reactance upon extension of his or her legs.

* * * * *